United States Patent [19]

Karl

[11] Patent Number: 4,637,418

[45] Date of Patent: Jan. 20, 1987

[54] FLUID FRICTION REDUCTION

[75] Inventor: Curtis L. Karl, Minneapolis, Minn.

[73] Assignee: Henkel Corporation, Minneapolis, Minn.

[21] Appl. No.: 664,470

[22] Filed: Oct. 25, 1984

Related U.S. Application Data

[63] Continuation-in-part of Ser. No. 497,336, Mar. 20, 1983, abandoned.

[51] Int. Cl.[4] ..... F17D 1/16

[52] U.S. Cl. ..... 137/13; 252/8.551; 406/47; 406/49

[58] Field of Search ..... 252/8.55 R, 8.55 C; 137/13; 406/47, 48, 49

[56] References Cited

U.S. PATENT DOCUMENTS

| | | | |
|---|---|---|---|
| 3,254,719 | 6/1966 | Root | 252/8.55 X |
| 3,442,803 | 5/1969 | Hoover et al. | 252/8.55 |
| 3,768,565 | 10/1973 | Persinski et al. | 137/13 X |
| 4,053,323 | 10/1977 | Adams et al. | 106/100 |
| 4,065,422 | 12/1977 | Lundmark et al. | 252/48.6 X |
| 4,107,057 | 8/1978 | Dill et al. | 252/8.55 |
| 4,128,631 | 12/1978 | Lundmark et al. | 424/70 |
| 4,242,098 | 12/1980 | Braun et al. | 137/13 X |
| 4,305,688 | 12/1981 | Savins | 406/197 |

FOREIGN PATENT DOCUMENTS

| | | | |
|---|---|---|---|
| WO83/01583 | 5/1983 | PCT Int'l Appl. | 137/13 |
| 0685594 | 9/1979 | U.S.S.R. . | |

OTHER PUBLICATIONS

Rheothik Polysulfonic Acid, Rheothik Polymer 80-11, Technical Bulletin by Henkel Corporation, Minneapolis, MN, Distributed 2-18-83, pp. 1-6.

*Primary Examiner*—Herbert B. Guynn
*Attorney, Agent, or Firm*—Ernest G. Szoke; J. Daniel Wood; Patrick J. Span

[57] ABSTRACT

Liquid containing composition, and the transport of pumping thereof are disclosed, which compositions achieve maximum fluid friction reduction properties at low concentration of a drag reducing agent such as less than 0.015% by weight and preferably less than 0.01% by weight. The drag reducing agent is a polymer of 2-acrylamido-2-methylpropanesulfonic acid. Finely divided solids, such as coal, may be suspended therein.

10 Claims, No Drawings

FLUID FRICTION REDUCTION

This application is a continuation-in-part of application Ser. No. 497,336, filed Mar. 20, 1983, now abandoned.

BACKGROUND

The present invention relates generally to liquid containing compositions and transport or pumping thereof, which compositions achieve maximum fluid friction reduction properties at low concentrations of a drag reducing agent, such as less than 0.015% by weight and preferably less than 0.01% by weight of a drag reducing polymer of 2-acrylamido-2-methylpropanesulfonic acid, or soluble salts thereof.

In U.S. Pat. No. 3,931,089 there is disclosed the use of polymeric 2-acrylamido-2-methylpropanesulfonic acid as a thickener for acid solutions which find utility in acidizing of oil wells. The thickening polymer is employed in amounts of 0.05–5.0%, generally about 1–4%, by weight. Reference is also made to the use of certain alcohols as stabilizers.

In U.S. Pat. No. 4,332,688 the use of oxyalkylated acrylamido alkanesulfonic acid polymers in aqueous solution of acids is disclosed for thickening and facilitating flow in the subterranean hydrocarbon-bearing formation. The polymer is employed in an amount of about 0.5 to about 5% by weight.

Again, in U.S. Pat. No. 4,107,057 well acidizing or fracturing compositions are disclosed using a cross-linked sulfonic acid modified acrylamide, 25–100 pounds per 1,000 gallons of base fluid.

U.S. Pat. Nos. 4,242,098 and 4,375,358 relate to the transport of slurries of solid materials, particularly of carbonaceous materials such as coal, in aqueous systems using a variety of water soluble polymers at levels of 0.05–5.0%, and generally 0.3–1.0%, by weight. Among such polymers are included poly(ethylene)oxide, partially hydrolyzed polyacrylamide, cellulose derivatives and gums such as xanthan gum and guar derivatives.

U.S. Pat. Nos. 4,065,422 and 4,128,631 relate to the use of acrylamide alkyl sulfonic acid polymers in personal care products which may be used in keratinous substrates such as skin or hair. While not relating to transport or pumping of materials such as contemplated by the present invention, the patent does describe "high slip" properties and a high degree of lubricity in the personal care products which employ alcohol as a carrier or solvent therefor. The polymer is employed in an amount preferably of 0.1–10% by weight, but a general range of 0.01–50% is disclosed.

As can be seen from the foregoing, the acrylamide alkane sulfonic acid polymers have been used in the past generally as thickeners for aqueous solutions employed in subterraneous formations in oil and gas recovery operations. In such operations, large amounts of an aqueous composition are employed which must be pumped and transported requiring high amounts of energy to pump the fluid, particularly with thickened compositions. In such applications, the phenomenon of "drag reduction" or "friction reduction" is economically important because it lowers the energy required to pump a fluid at a given rate or it permits the fluid to be pumped faster at the same energy input. Such energy savings are of course desirable in transportation or pumping of liquids, either by themselves or where used as carriers for other materials in finely divided form.

Drag reduction can be defined as the increase in the ease of pumpability of a fluid caused by the addition of small amounts of another substance to the fluid. During drag reduction, the fluid containing the additive requires a lower pressure gradient to move it at a given mean velocity in a pipe than the same fluid without the additive. Although a large number of experimental studies have been carried out to investigate this phenomenon of drag reduction, the exact mechanism is not well understood. Many researchers do agree, however, that drag reduction is caused by some kind of interaction between turbulent eddies and the dissolved polymers near the pipe walls, N. D. Sylvester and J. S. Tyler, Ind. Eng. Chem. Prod. Res. Develop., Vol. 9, No. 4, 1980, p. 548.

Extensive use of drag reduction additives is being made in petroleum production operations, particularly in fracturing processes where fluids are pumped at high pressures and flow rates. Other promising applications for drag reduction additives are in ship hull friction reduction, in pipelines, in fire fighting hoses, in water and sewer systems, and in sprinkler irrigation systems.

BRIEF SUMMARY

This invention relates to the use of polymers of 2-acrylamide-2-methylpropanesulfonic acid (AMPS) in liquid containing compositions and to the transport or pumping of such compositions. The polymers perform as a drag reducing agent additive and provide for an increase in the volumetric flow rate of the liquid such as water and/or alcohol at a given pressure drop. The invention finds particular utility with alcohols, or compositions containing alcohols, in view of national or local synfuel programs which will require pipeline transportation of large amounts of alcohol during the next decade. In addition, the alcohol might serve as a carrier for finely divided fuel, such as coal, permitting the simultaneous transportation or pumping of the two fuels.

The use of polymers has been found to provide maximum friction reduction properties employing low concentration in amounts less than 0.015% by weight, and even less than 0.01% by weight. The fluid friction reduction properties (FFR) develop or are achieved quickly, generally in less than 10–15 minutes.

DESCRIPTION OF THE INVENTION

The polymers employed in the present invention are prepared from an acrylamido-methylpropane sulfonic acid, such as, 2-acrylamido-2-methylpropane sulfonic acid, which is commercially available and sold under the trademark "AMPS" by the Lubrizol Corporation.

It has the structural formula:

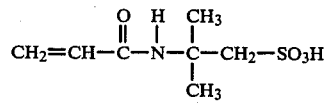

Polymerization of this monomer is known in the art and described by the Lubrizol Corporation as follows:

"The following recipes are given as a guide to the homopolymerization and copolymerization of AMPS (2-acrylamido-2-methylpropanesulfonic acid) monomer and its sodium salt. The polymerizations, except where noted otherwise, should be conducted in a resin flask equipped with a stirrer, gas inlet tube, condenser and thermometer. All solutions should be purged for one hour with nitrogen or argon before adding the initiator, with purging continued during the polymerization. All amounts are in grams.

AMPS (2-acrylamido-2-methyl-propanesulfonic acid) Monomer: 100
Distilled Water: 100
Ferrous Sulfate Heptahydrate: 0.01
Hydrogen Peroxide 0.05% Solution: 0.25

Prepare a solution of AMPS monomer in water in an 800 ml beaker. Purge. Add the ferrous sulfate and hydrogen peroxide. The solution gels almost instantly. The temperature rises to 75°-80° C. in about two minutes. Cool to room temperature. Cut gel into pieces and dry at 60° C. in a vacuum oven."

In addition, preparation of the polymers can be found in the U.S. Patents noted in the background discussion above and may also be found described in Canadian Patent No. 864,433, as well as other publications dealing with the preparation of these materials.

The polymers can also be further generally defined as those having the repeating linkage

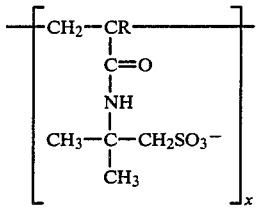

where x is value substantially defining the molecular weight of the product and R is H or $CH_3$. The terminal groups, which generally have little bearing on the desired properties, are most often hydrogen, but may also be others such as hydroxyl, sulfate, sulfonate, or

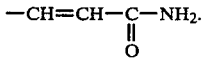

The cation, which may be designated as M, associated with the anionic portion will generally be H, for the acid form, and in the salt form will preferably be sodium, potassium, ammonium, monoethanolamine, diethaneolamine, triethanolamine mixtures thereof. In the present invention the polymers preferably have a molecular weight above 5,000,000 but polymers having lower molecular weights down to about 1,000,000 may also be used. It is generally desirable to employ a polymer having a molecular weight of at least 3,000,000 however polymers at the lower end of the range of about 1,000,000 molecular are now being offered as of Feb. 18, 1983, by Henkel Corporation under the tradename "RHEOTHIK". A polymer having a molecular weight of about 4,000,000 would have a Brookfield viscosity, using a No. 1 spindle at 2.5 rpm on a solution in water of 0.5% by weight concentration of about 1370 cps. The polymers employed in the examples herein for fluid friction reduction gave a viscosity of 3000-6000 cps under the same conditions indicating molecular weights in excess of 5,000,000, but generally below 10,000,000.

The polymerization reaction is generally described as temperature, pH, and catalyst sensitive. In addition, it is desirable to exclude oxygen from the reaction vessel used to form the polymer, as that material inhibits the polymerization process. The catalysts which are included to enhance the rate of polymerization are materials such as ammonium bisulfite, ferrous sulfate, hydrogen peroxide, sodium metabisulfite, or other redox catalysts. Catalysts are particularly useful when monomers of lower purity, or lower solids concentration, i.e. 30% solid by weight in water are employed. When monomers of high purity and high concentration, 50% by weight, are employed catalysts are generally not required to produce polymerization.

The polymers useful in the compositions and processes of this invention may contain, as comonomers, any monoethylenically unsaturated polymerizable compound that will not adversely affect the solubility and drag reducing ability of the resulting copolymer. Examples of suitable comonomers include acrylamide, acrylic acid, methyl acrylate, methacrylamide and the like. The amount of comonomer in the polymer should not exceed about 25% by weight of all monomers, preferably not more than 10% by weight of all monomers. The most preferred polymer is a homopolymer of 2-acrylamido-2-methylpropanesulfonic acid.

The homopolymers employed in the examples below illustrating the present invention were prepared from the higher (50%) concentration in water using a mixture of potassium persulfate, potassium metabisulfite, and ferrous sulfate catalyst. Nitrogen is bubbled through the mixture until polymerization begins. The polymerization begins in about 30 minutes and is accompanied by an increase in temperature. The reaction is completed within 30 minutes. The resulting gel, after cooling, is then cut up and dried overnight in a vacuum oven at aspirator pressure and a temperature of about 50° C. Then the polymer is ground to powder.

Polymers of the lower weights can be prepared following the procedures found in Example I and II, and U.S. Pat. Nos. 4,065,422 and 4,128,631 referred to earlier above.

The polymers are then dissolved in the particular liquid composition in which it is desired to provide fluid friction reduction or drag reduction properties. As indicated earlier above, the maximum fluid friction reduction is achieved in a very short time, usually less than 10-15 minutes preferably in about 1-2 minutes, using small quantities of the drag reducing polymer. The effect is achieved using amounts less than 0.015% by weight of the polymer in the liquid and generally less than 0.01%. Most of the friction reduction effect is achieved at levels as low as 0.003%. Additional amounts beyond the 0.015% may provide a thickening effect but generally retard the fluid friction reduction effect.

The liquid system or compositions to which the polymer may be added to provide the desired fluid friction reduction effects are those containing water or alcohol or mixtures thereof. Thus, the invention finds utility in aqueous systems such as salt solutions, acid or base solutions. The invention finds particular utility, however, in alcohol systems, either anhydrous or aqueous containing systems. It is particularly useful with methanol systems as other soluble polymers do not appear to function in such a system, especially an anhydrous methanol composition.

In addition to the liquid itself, either water, alcohol or a mixture thereof, as can be appreciated, other materials may be present such as a salt, acid or base. Thus, the invention has applicability to API brine solutions, or acidizing solutions such as are used in oil recovery areas. An API brine solution is generally one defined as a water solution of 7.5% NaCl, 0.73% $CaCl_2.H_2O$ and 0.425% $MgCl_2.6H_2O$. The presence of these particular cations are generally thought to retard drag reduction in anionic polyacrylamides. In the present invention, however, high levels of drag reduction are illustrated and provided. In oil well applications these wells are frequently cleaned or fractured using strong acid solution such as 18% hydrochloric acid. The present invention again provides highly effective drag reduction properties. Few polymers are soluble in anhydrous propanol at room temperature. Also, oil wells are sometimes fractured with non-aqueous fluids in cases where the formation may be damaged by water. Anhydrous methanol is one of the least expensive non-aqueous solvents available but few polymers are soluble in it or will provide the properties achieved by the present invention.

It is often advantageous to have a drag reducing agent in the form of a powdered solid. This physical form requires that the polymer dissolve rapidly, yielding maximum drag reduction in a few minutes. The present invention meets this requirement readily, reaching their maximum drag reduction in aqueous systems in about one minute and in alcohol systems in about 2 minutes. In addition the composition of the present invention appears to be sufficiently stable to shear forces encountered during pumping to be of practical value.

The invention is applicable to all alcohol systems, particularly the monohydric alcohols such as the alkanols: methanol, ethanol, propanol and isopropanol. Polyols, such as glycerin, ethylene, or propylene, glycol also find utility in this invention.

As indicated, the invention finds utility in the transport or pumping of liquids. It is particularly useful in the transport of finely divided solids employing a liquid such as water or alcohol as the carrier for the finely divided solid, which results in a slurry to be pumped. Particularly as the finely divided solids content approach high levels of 40%, 50%, or higher, the drag reduction effect is of value in the pumping of the slurry. The transport of coal, or any solid carbonaceous material (coke, lignite) is of significance today using water as a carrier in an aqueous system or an alcohol, which may also require pipeline transport in view of synfuel program being considered.

A pumpable slurry considered herein would be one containing the water or alcohol as the liquid carrier in sufficient amount to provide a pumpable slurry containing the drag reducing polymer in an amount to provide its maximum friction reduction properties, with the finely divided solids constituting substantially the balance of the composition. In addition, when desired, or required, additional thickening, viscosity builders or wetting agents may also be employed to optimize transport of the material. Slurries to which the present invention is applicable are those which are highly loaded, i.e. at least 40% by weight of the slurry, and more preferable at 60–70%. The amount of solid which can be used is a function of the particle size of the material. With carbonaceous materials such as coal, preferably a substantial amount, such as 90%, of the solid material should pass a 60-mesh sieve (Tyler Standard Sieve Series) and most perferably at least 80% should pass a 100 mesh sieve.

The following examples will serve to further illustrate the invention in which all percentages and parts are by weight unless otherwise noted.

EXAMPLE I

In this example, a polymer of 2-acrylamido-2-methylpropanesulfonic acid having a molecular weight in excess of 5,000,000 (Polymer I) was employed in anhydrous isopropanol to determine the fluid friction reduction (FFR) or drag reduction properties. The viscosity of Polymer I measured as earlier described hereinabove (Brookfield viscosity, No. 1 spindle, 2.5 rpm, 0.5% by weight concentration in water) was 4040 centipoises (cps). In measuring drag reduction, it was chosen to measure the pressure drop of a liquid flowing at a constant rate through 4.0 feet of ⅜ inch pipe. This is done in a portable Rheometer Flow Friction Apparatus (from Halliburton Company). The liquid flows at 18 feet per second from a progressing-cavity pump driven by a constant speed motor. Pressure drop is measured with either a pressure gauge or with a pressure transducer coupled to a recorder.

Zero drag reduction is the pressure drop of the flowing solvent without any additives. The pressure head at no flow provides the 100% drag reduction setting on the recorder. Percent drag reduction for solvents containing additives can then be recorded directly on chart paper. The polymer was added to the anhydrous isopropanol by an incremental addition method in which the polymer was predissolved in a portion of the isopropanol.

This incremental addition method involves simultaneously starting the recorder which is preset at time zero and adding all at once to the liquid being pumped the amount of polymer needed to achieve the desired concentration. After maximum FFR is achieved, a second amount of polymer is added to achieve the next desired higher concentration of polymer in the total liquid. This is repeated a number of times until the maximum concentration is achieved.

The results can be seen from the following Table I in which a comparison with an hydroxypropyl cellulose product (Klucel HA) is included.

TABLE I

FLUID FRICTION REDUCTION DATA IN ANHYDROUS ISOPROPANOL

| POLYMER CONCENTRATION | | | EXAMPLE 1 | | EXAMPLE 2 | |
|---|---|---|---|---|---|---|
| (ppm) | (pounds per 1000 gallons) | % by weight | Time at Addition (Min.) | Max. % FFR | Time at Addition (Min.) | Max. % FFR |
| 30 | 0.25 | .003 | 0 | 39% | 0 | 3% |
| 60 | 0.50 | .006 | 2 | 62% | 2 | 6% |
| 120 | 1.00 | .012 | 4 | 64% | 4 | 10% |
| 240 | 2.00 | .024 | 7 | 64% | 6 | 18% |
| Sample: | | | Predissolved | | Predissolved | |

TABLE I-continued

| FLUID FRICTION REDUCTION DATA IN ANHYDROUS ISOPROPANOL | | | | | | |
|---|---|---|---|---|---|---|
| POLYMER CONCENTRATION | | | EXAMPLE 1 | | EXAMPLE 2 | |
| | | | Time at | | Time at | |
| (ppm) | (pounds per 1000 gallons) | % by weight | Addition (Min.) | Max. % FFR | Addition (Min.) | Max. % FFR |
| | | | Polymer I | | Klucel HA | |

EXAMPLE II

In the same manner the fluid friction reduction properties in anhydrous methanol were studied using several polymers having a molecular weight in excess of 5,000,000 including that of Example I added in both dry powdered form as well as predissolved form as in Example I.

The results can be seen from the following Table II, in which the viscosity data was measured as earlier described.

TABLE II

| FLUID FRICTION REDUCTION DATA IN ANHYDROUS METHANOL | | | | | | | | | | | | |
|---|---|---|---|---|---|---|---|---|---|---|---|---|
| POLYMER CONCENTRATION | | | SAMPLE 3 | | SAMPLE 4 | | SAMPLE 5 | | SAMPLE 6 | | SAMPLE 7 | |
| (ppm) | (pounds per 1000 gal.) | % by wt. | Time at Addition (min.) | Max. % FFR | Time at Addition (min.) | Max. % FFR | Time at Addition (min.) | Max. % FFR | Time at Addition (min.) | Max. % FFR | Time at Addition (min.) | Max. % FFR |
| 30 | 0.25 | .003 | 0 | 70% | 0 | 56% | 0 | 8% | 0 | 85% | 0 | 74% |
| 60 | 0.50 | .006 | 10 | 80% | 10 | 69% | 8 | 65% | 2 | 87% | 3 | 82% |
| 120 | 1.50 | .012 | 0 | 87% | 0 | 81% | 11 | 82% | 4 | 85% | 6 | 85% |
| 240 | 2.00 | .024 | 10 | 80% | 10 | 81% | 15 | 81% | 6 | 85% | — | — |
| Sample: | | | Dry Powdered Polymer II | | Dry Powdered Polymer III | | Dry Powdered Polymer I | | Predissolved Polymer I | | Predissolved Polymer IV | |
| Viscosity | | | 6440 cps | | 4420 cps | | 4040 cps | | 4040 cps | | 3280 cps | |

EXAMPLE III

In the same manner as Example I, the properties in aqueous methanol were determined, using varying alcohol to water ratios (volume/volume). The results can be seen from the following Table III.

TABLE III

| FLUID FRICTION REDUCTION DATA IN ANHYDROUS METHANOL | | | | | | | | | |
|---|---|---|---|---|---|---|---|---|---|
| POLYMER CONCENTRATION | | SAMPLE 8 | | SAMPLE 9 | | SAMPLE 10 | | SAMPLE 11 | |
| (ppm) | (pounds per 1000 gal.) | Time at Addition (min.) | Max. % FFR | Time at Addition (min.) | Max. % FFR | Time at Addition (min.) | Max. % FFR | Time at Addition (min.) | Max. % FFR |
| 30 | 0.25 | 0 | 44% | — | — | — | — | — | — |
| 60 | 0.50 | 10 | 60% | 0 | 68% | 0 | 62% | 0 | 62% |
| 120 | 1.00 | 0 | 76% | 4 | 72% | 4 | 66% | 4 | 66% |
| 240 | 2.00 | 10 | 75% | — | — | — | — | 16 | 63% |
| Solvent: | | Dry Powdered Polymer II | | Dry Powdered Polymer III | | Dry Powdered Polymer III | | Dry Powdered Polymer III | |
| Solvent (alcohol to water) | | 95/5 | | 90/10 | | 70/30 | | 50/50 | |

EXAMPLE IV

Polymer II was also employed in determining FFR in water, API brine and 18% HCl. The % FFR achieved at a concentration of 0.50 pounds per 1000 gallon (0.006% by weight) were as follows:

| FLUID | % FFR |
|---|---|
| Water | 79 |
| API brine | 68 |
| 18% HCl | 75 |

What is claimed is:

1. In a method for transporting or pumping liquid compositions, the improvement wherein said liquid consists essentially of an alcohol and said liquid has dissolved therein a drag reducing polymer of 2-acrylamido-2-methylpropane sulfonic acid in an amount less than 0.015% by weight based on the weight of said liquid, said polymer having a molecular weight of at least 1,000,000.

2. A method as defined in claim 1 wherein said polymer has a molecular weight in excess of 5,000,000.

3. A method as defined in claim 1 wherein the polymer is present in an amount of from 0.015% to 0.003% by weight based on the weight of the liquid.

4. A method as defined in claim 1 wherein said liquid contains a finely divided solid suspended therein.

5. A method as described in claim 4 wherein the liquid also contains a member selected from the group consisting of an acid, a base and a salt.

6. A method as described in claim 5 wherein the polymer contains less than 10% by weight of a comonomer selected from the group consisting of: acrylamide, acrylic acid, methyl acrylate, and methacrylamide.

7. A method as defined in claim 4 wherein said finely divided solid is present in an amount of at least 40% by weight to provide a pumpable slurry.

8. A method as defined in claim 7 wherein said solid is a carbonaceous material.

9. A method as defined in claim 8 wherein said carbonaceous material is coal and said liquid is an alcohol.

10. A method as defined in claim 9 wherein said alcohol is methanol.

* * * * *